United States Patent [19]

Williams

[11] Patent Number: 4,491,354

[45] Date of Patent: Jan. 1, 1985

[54] LOCK BAR

[75] Inventor: Lawrence D. Williams, Windsor, Canada

[73] Assignee: Precision Hardware, Inc., Detroit, Mich.

[21] Appl. No.: 956,938

[22] Filed: Nov. 2, 1978

Related U.S. Application Data

[63] Continuation of Ser. No. 745,634, Nov. 29, 1976, abandoned.

[51] Int. Cl.[3] ..... E05C 1/04; E05C 7/04

[52] U.S. Cl. ..... 292/148; 70/417; 70/432; 292/150; 292/259 R; 292/DIG. 53

[58] Field of Search ..... 292/148, 150, 151, 259, 292/327, 32, 42, 137, 145, 147, DIG. 17, DIG. 53, DIG. 32; 70/432, 417, DIG. 59, DIG. 64, DIG. 65, 441

[56] References Cited

U.S. PATENT DOCUMENTS

| | | | |
|---|---|---|---|
| Re. 22,918 | 9/1947 | Dray | 292/148 |
| 338,463 | 3/1886 | Barrett | 292/145 |
| 1,593,684 | 7/1926 | Anakin | 70/417 X |
| 1,956,963 | 5/1934 | Salmen, Jr. | 85/45 |
| 2,240,162 | 4/1941 | Nemec | 292/148 |
| 2,458,046 | 1/1949 | Audet | 292/150 X |
| 2,783,960 | 3/1957 | Herz et al. | 108/56.1 |
| 2,913,296 | 11/1959 | Martin | 292/259 X |
| 3,466,965 | 9/1969 | McCarthy | 151/68 X |
| 3,655,229 | 4/1972 | Tumbiolo | 292/148 |
| 3,656,788 | 4/1972 | Emery | 292/148 |
| 3,752,518 | 8/1973 | Cannell | 292/148 X |

FOREIGN PATENT DOCUMENTS

| | | | |
|---|---|---|---|
| 853639 | 12/1939 | France | 292/148 |
| 614146 | 12/1960 | Italy | 292/147 |
| 690247 | 4/1953 | United Kingdom | 70/417 |

*Primary Examiner*—William E. Lyddane
*Attorney, Agent, or Firm*—Barnes, Kisselle, Raisch, Choate, Whittemore & Hulbert

[57] ABSTRACT

A lock bar for securing a pair of door panels having lock and hinge edges in a locked position and indicating whether or not the panels are locked, including a pair of elongated hollow holding brackets having a rectangular cross section aligned horizontally and secured to the door panels adjacent the lock edges thereof, and an elongated, hollow, rectangular cross section, cross bolt extending horizontally through the holding brackets.

3 Claims, 12 Drawing Figures

LOCK BAR

This is a continuation of application Ser. No. 745,634, filed Nov. 29, 1976 now abandoned.

In modification of the invention, a single holding bracket is utilized and the cross bolt extends either into a wall adjacent a single swinging door panel for locking the single door panel, or into a floor for locking a sliding door.

In either modification, the cross bolt is of a distinctive color, and hasp means adapted to extend through a holding bracket and the cross bolt is provided for locking the cross bolt in two different positions in which the door panels or panel are in locked an unlocked conditions whereby the condition of the door panels or panel as either locked or unlocked may be determined at a glance.

BACKGROUND OF THE INVENTION

1. Field of the Invention

The invention relates to locking devices for door panels and the like, and in a preferred embodiment refers more specifically to a lock bar including a pair of horizontally aligned and spaced apart holding brackets secured to a pair of door panels adjacent lock edges thereof, a cross bolt positioned therein and extending therebetween which is of a distinctive color, and means for locking the cross bolt in a locking position within the holding brackets wherein only the portion of the cross bolt extending between the holding brackets is visible, and in an unlocking position wherein a substantial portion of the cross bolt is visible extending out of one of the holding brackets whereby a visual indication of the locked or unlocked condition of the door is provided.

2. Description of the Prior Art

In the past, locking devices for doors have included various bolts, bars and the like, which have provided little or no visual indication of the locked or unlocked condition thereof. Further, such devices have in the past been opened, broken or otherwise circumvented with relative ease by criminals, so that security with prior devices has been questionable.

SUMMARY OF THE INVENTION

The invention in the preferred embodiment is a positive, heavy-duty lock bar for a pair of door panels having hinge edges and adjacent lock edges, including a pair of hollow holding brackets having a rectangular cross section, stud and washer means for securing the brackets in horizontal spaced apart alignment to the door panels adjacent the lock edges of the panels, a hollow rectangular cross bolt adapted to extend through and between the holding brackets, pin means for preventing movement of the cross bolt out of the hinge edge end of one of the holding brackets, and releasable locking means for selectively preventing movement of the cross bolt out of the hinge edge end of the other of the holding brackets and locking the cross bolt in a position extending out of the hinge edge end of the other holding bracket.

The cross bolt of the lock bar of the invention is given a distinctive, highly visible color so that it can readily be seen extending between the holding brackets when the door panels are in a locked condition, and can readily be seen extending out of the hinge edge end of the other bracket when the door panels are in an unlocked condition.

In a modification of the lock bar of the invention, the lock bar may be used in a horizontal position with a single holding bracket with a single door panel, or in a vertical position with a single bracket for a sliding door panel, to lock the single door panel or the sliding door panel in a manner similar to the locking of the pair of door panels and again provide visual indication of both the locked and unlocked condition of the door panels in these applications of the lock bar.

DESCRIPTION OF THE PREFERRED EMBODIMENTS

Figure 1:
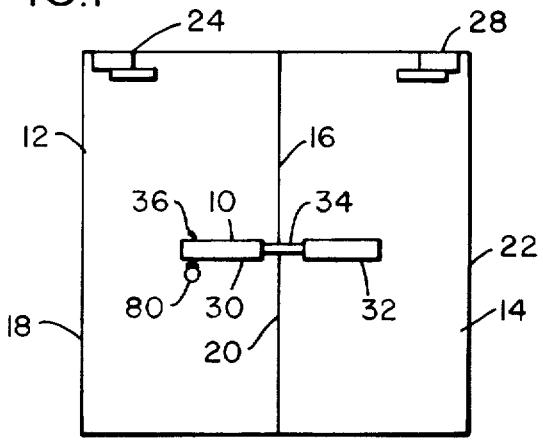
FIG. 1 is an elevation view of a pair of door panels including lock bar structure constructed in accordance with the invention secured thereto and locked in a visible locking condition.
Figure 2:
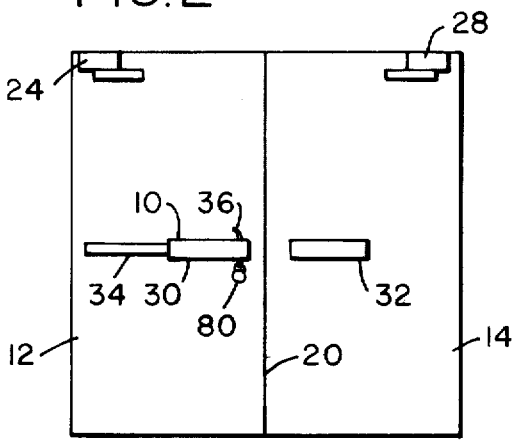
FIG. 2 illustrates the lock bar structure of FIG. 1 locked in a visible unlocking condition.
Figure 3:
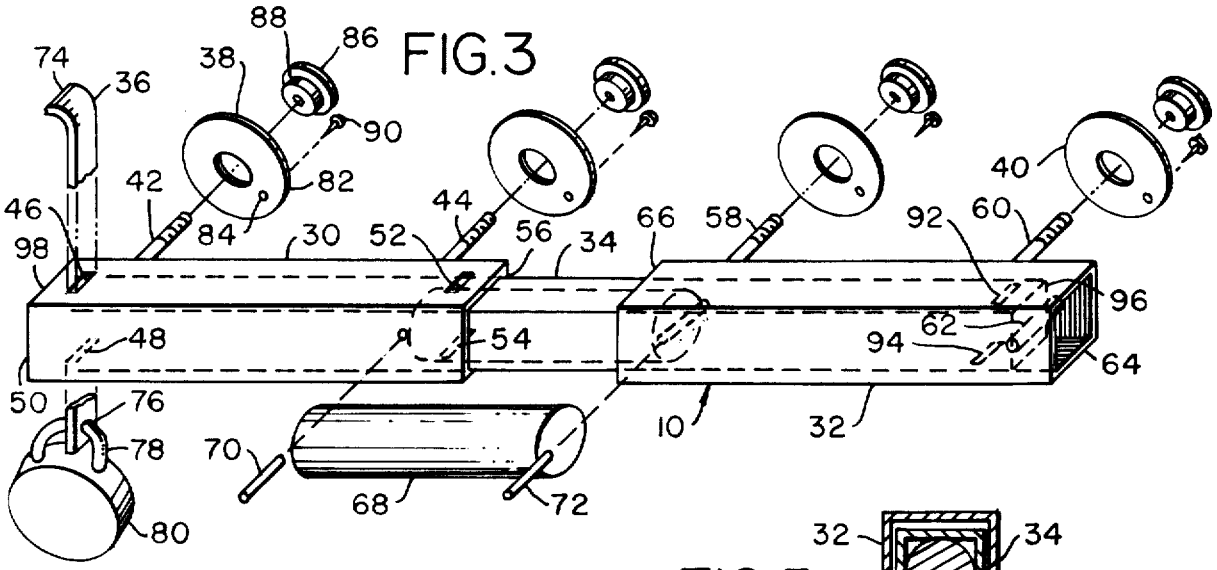
FIG. 3 is an enlarged exploded isometric view of the lock bar structure illustrated in FIGS. 1 and 2 in a locking condition as shown in FIG. 1.

The lock bar of the invention 10, as shown best in FIG. 3, is illustrated in FIGS. 1 and 2 in conjunction with a pair of door panels 12 and 14. The door panel 12 has a lock edge 16 and a hinge edge 18, while the door panel 14 has a lock edge 20 and a hinge edge 22. As shown in FIG. 1, the lock bar 10 is in a locking condition, while the lock bar 10 as shown in FIG. 2 is in an unlocking condition. As shown in FIGS. 1 and 2, the door panels 12 and 14 are provided with the usual closers 24 and 28.

The lock bar 10 includes the holding brackets 30 and 32, the cross bolt 34 and the hasp 36. Means 38 and 40 are provided for securing the holding brackets 30 and 32 to the door panels 12 and 14, respectively.

In more detail, the holding bracket 30 is an elongated hollow member of structural steel having a rectangular cross section. Threaded studs 42 and 44 are welded to one side of the holding bracket 30 and in installation extend through the door panel 12 for engagement with the means 38 for securing the holding bracket 30 to the door panel 12, as will be considered subsequently.

The holding bracket 30 is further provided with the vertically aligned rectangular slots 46 and 48 in the hinge edge end 50 thereof for receiving the hasp 36 with the lock bar 10 in a locking condition, as will be considered subsequently. Similar slots 52 and 54 are provided in the lock edge end 56 of the holding bracket 30, as shown best in FIG. 3, to receive the hasp 36 with the lock bar 10 in an unlocking condition.

The holding bracket 32 is provided with threaded studs 58 and 60 welded thereto which are similar to the studs 42 and 44 and which cooperate with the means 40 for retaining the holding bracket 32 on the door panel 14, as will be considered subsequently.

A roll pin 62 extends across the hinge edge end 64 of the holding bracket 32, as shown in FIG. 3. Roll pin 62 is constructed to roll if sawing of the pin is attempted and is positioned to prevent movement of the cross bolt 34 through the end 64 of the holding bracket 32.

The means 38 and 40 for securing the holding brackets 30 and 32 to the door panels 12 and 14 are similar. Therefore, only one of the means 38 will be considered in detail. The means 38 for securing the holding bracket 30 to the door panel 12 includes a separate large diameter washer 82 having an offset screw opening 84 therein and a dual diameter retaining member 86 having a threaded bore 88 therethrough. A screw having a one-way slotted head 90 is provided in conjunction with washer 82. A separate washer, retaining member and screw are included in each means 38 and 40 for securing the holding brackets to the door panels 12 and 14.

Figure 5:
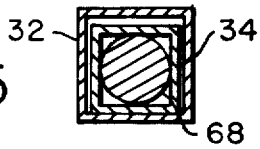
FIG. 5 is a cross section view of the lock bar structure illustrated in FIG. 4, taken substantially in the direction of arrows 5—5, FIG. 4.

The cross bolt 34 is also an elongated hollow structural steel member having a rectangular cross section. The rectangular cross section of the cross bolt 34 is smaller in both dimensions than the holding brackets 30 and 32, as shown in FIG. 5, to permit movement of the cross bolt 34 longitudinally of the holding brackets 30 and 32 within the holding brackets. The cross bolt 34 is shorter than the combined holding brackets 30 and 32 and the distance between the lock edge ends 56 and 66 thereof by the distance the slots 46 and 48 and the roll pin 62 are set in from the lock edge ends 50 and 64 of the holding brackets 30 and 32, respectively. Accordingly, the cross bolt 34 substantially fills the brackets 30 and 32 when the lock bar 10 is in a locked configuration.

A hardened steel roller 68 having a diameter only slightly smaller than the inside rectangular dimension of the cross bolt 34 is provided centrally of the cross bolt and in particular extends across the lock edges of the door panels 12 and 14 with the lock bar 10 in a locking condition, as shown in FIGS. 1 and 3 through 6. The hardened steel bar 68 is maintained in axial position within the cross bolt 34 by means of pop rivets 70 and 72 or the like extending transversely through the cross bolt adjacent the ends of the hardened steel bar 68.

Figure 4:
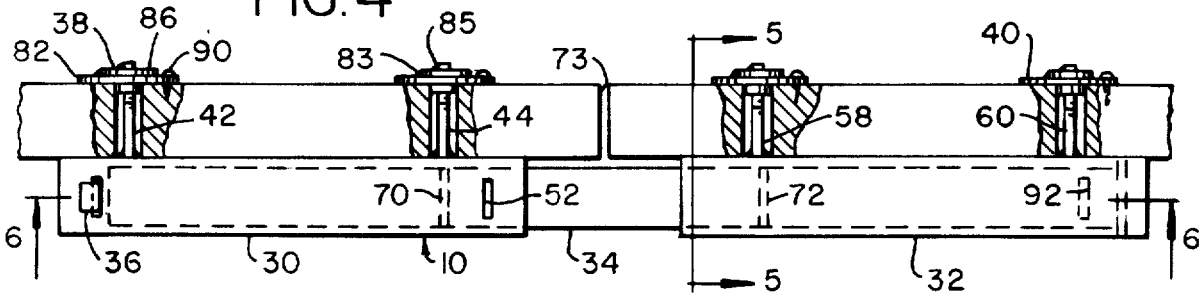
FIG. 4 is an enlarged top view of the lock bar structure as illustrated in FIG. 1.
Figure 6:
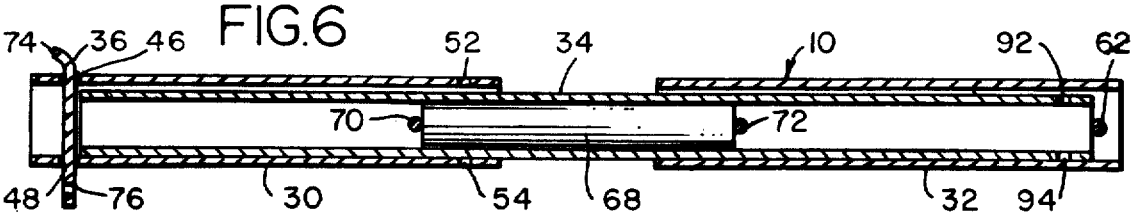
FIG. 6 is a longitudinal section view of the lock bar structure illustrated in FIG. 4, taken substantially on the line 6—6, FIG. 4.

Accordingly, sawing or cutting of the cross bolt through a slot 73 between the door panels 12 and 14, as shown in FIG. 4, or at any place between the lock edge ends of the holding brackets 30 and 32, is inhibited. This is particularly true, since the bar 68 will roll if sawing thereof is attempted.

Figures 7, 8, 9, 10, 11, 12:
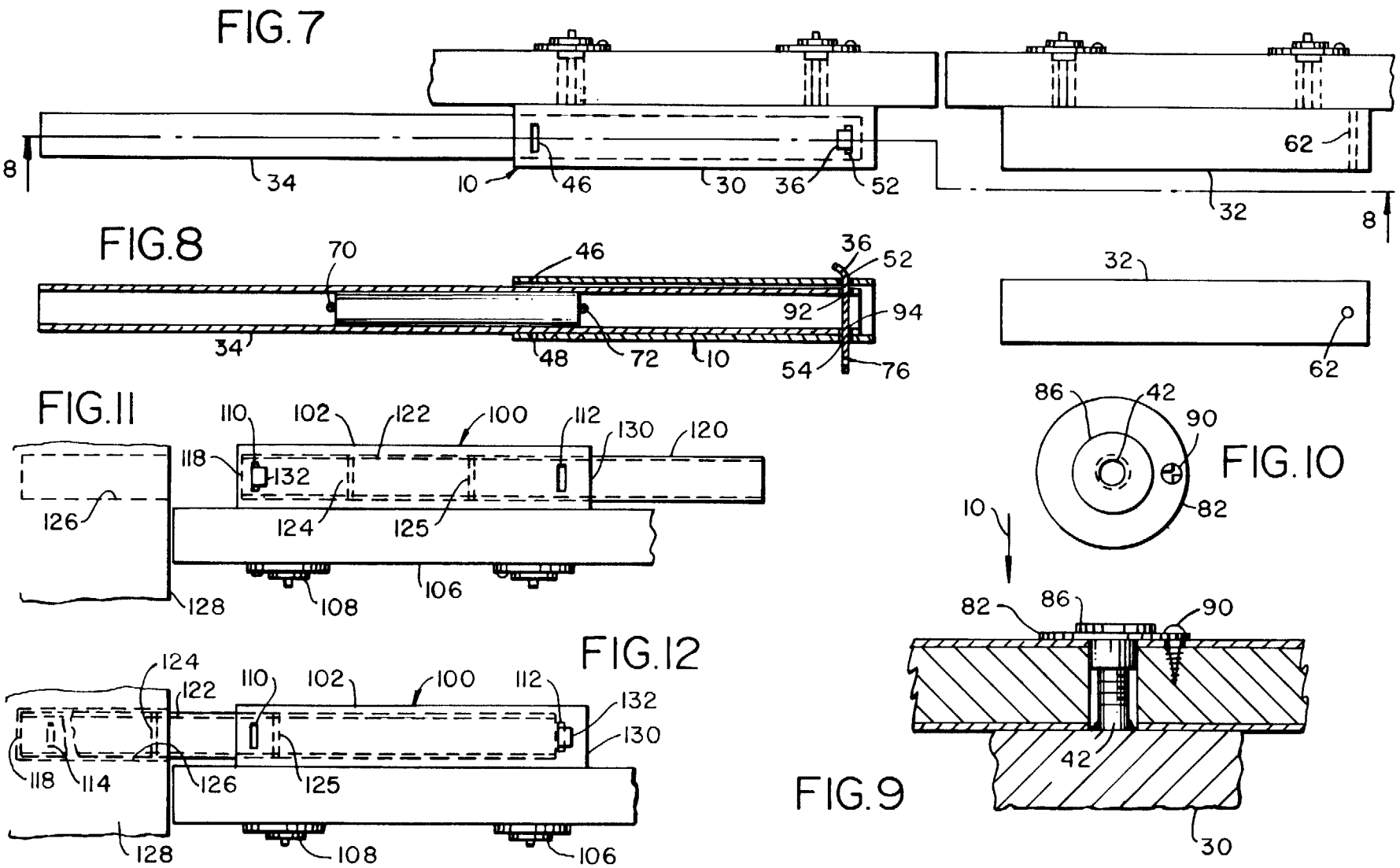
FIG. 7 is an enlarged top view of the lock bar structure as illustrated in FIG. 2.
FIG. 8 is a longitudinal section view of the lock bar structure illustrated in FIG. 7, taken substantially on the line 8—8, FIG. 7.
FIG. 9 is an enlarged cross section view of a portion of the lock bar structure as illustrated in FIG. 7 showing modified means for securing the holding brackets to the door panels.
FIG. 10 is an elevation view of the structure for securing the holding brackets to the door panels illustrated in FIG. 9, taken substantially in the direction of arrow 10 in FIG. 9.
FIG. 11 is a top view of modified lock bar structure for a single door panel, constructed in accordance with the invention, with the lock bar structure in an unlocking condition.
FIG. 12 is a top view of the modified lock bar structure shown in FIG. 11, with the lock bar structure in a locking condition.

Vertically aligned slots 92 and 94 are provided in one end of the cross bolt 34 as shown in FIGS. 3, 7 and 8 for securing the cross bolt 34 in an unlocking position, as will be considered subsequently.

The hasp 36, as shown, is a generally flat hasp or hardened steel having a generally rectangular cross section. The end 74 thereof is bent so as to prevent passage of the hasp 36 through the slots 46 and 48. A hole 76 is provided through the other end of the hasp 36 to accommodate the shackle 78 of a padlock 80, as desired.

In assembly, the holding brackets 30 and 32 are aligned horizontally on the door panels 12 and 14 with the bolts 42 and 44 and 58 and 60 extending through pre-drilled openings through the door panels 12 and 14. Washers, such as washers 38, are slipped over the bolts, after which retaining members such as members 88 are threaded onto the bolts to draw the holding brackets tight against the door panels, and one-way slotted screws are passed through opening 84 in the washers and into the door panels. The washers 82 and/or the retaining members 86 may be welded or otherwise secured to each other and/or to the bolt 42 as at 83 and 84 to prevent removal thereof. That is, in accordance with whether the side of the door panels 12 and 14 on which the washers, retaining members and screws are positioned, are exposed to tampering.

Alternatively, the retaining members 86, as shown in FIGS. 9 and 10, are open on only one end to receive stud 42. With retaining members 86 shaped as shown in FIGS. 9 and 10, welding of the stud 42 and/or washer 82 to retaining member 86 is not necessary.

With the holding brackets thus secured to the door panels 12 and 14, when it is desired to lock the door panels 12 and 14 in a closed position, the door panels are closed, the cross bolt is passed into the hinge edge end and out of the lock edge end of the holding bracket 30 and into the lock edge end of the holding bracket 32 into engagement with the roll pin 62 so as to place the steel bar 68 across the lock edges of the door panels 12 and 14. The hasp 36 is then inserted through the slots 46 and 48 and the shackle 78 of the padlock 80 is passed through the opening 76 in the hasp 36 to retain the cross bolt in a locking position.

The cross bolt 34 is painted a readily visible color in accordance with the invention and is painted a color which contrasts with the door panels 12 and 14 and the holding brackets 30 and 32. Accordingly, the locking condition of the lock bar 10 is readily visible from a substantial distance on viewing that portion of the cross bolt between the lock edge ends of the holding brackets 30 and 32 which are in axial spaced apart relation as shown, for example, in FIG. 1.

When it is desired to secure the lock bar 10 in an unlocking condition, as particularly shown in FIGS. 2, 7 and 8, the padlock 80 is unlocked, the shackle 78 is withdrawn from the opening 76, and the hasp then withdrawn from the slots 46 and 48. The cross bolt 34 is then withdrawn to align the slots 92 and 94 in the end thereof with the slots 52 and 54 in the holding bracket 30. The hasp 36 is then passed through the aligned slots 52, 92, 54 and 94 and the shackle 78 of the padlock 80 is again passed through the opening 76 in the hasp 36 to secure the cross bolt in a position wherein the end 98 thereof sticks out of the holding bracket 30 a considerable distance, as shown in FIGS. 2, 7 and 8. Thus, the unlocking condition of the lock bar 10 is also readily visible on casual inspection.

In the modified lock bar construction 100 shown in FIGS. 11 and 12, a single holding bracket 102 is secured adjacent the lock edge 104 of a single door panel 106 by means 108 similar to the means 38 and 40 for securing the holding brackets 30 and 32 to the door panels 12 and 14. As shown, the holding bracket 102 is similar to the holding bracket 30 in that it has pairs of vertically aligned slots 110 and 112 at the opposite ends thereof which match a similar pair of vertically aligned slots 114 in the end 118 of the cross bolt 120. In the single panel lock bar construction 100, the steel rod 122 is positioned between pins 124 and 125 as shown. The cross bolt 120 extends into and out of the holding bracket 102 and into and out of an opening 126 in a wall 128 or the like adjacent the lock edge 104 of the door panel 106. The cross bolt is locked in a locking or unlocking condition by the hasp 132 and associated padlock (not shown) as before.

Again, the locking or unlocking condition of the lock bar 100 may be determined by viewing the portion of the cross bolt extending between the holding bracket 102 and the wall 128 or the portion of the cross bolt 120 extending out of the hinge edge end 130 of the holding bracket 102.

While one embodiment of the present invention and modifications thereof have been considered herein in detail, it will be understood that other embodiments and modifications of the lock bar structure 10 are contemplated. Thus, for example, the single lock bar modification 100 of the lock bar 10 may be used in a vertical configuration in conjunction with sliding doors such as boxcar doors and the like, if desired. It is intended to include all such embodiments and modifications as are defined by the appended claims within the scope of the invention.

What I claim as my invention is:

1. A lock bar for securing adjacent door panels each having a hinge edge and a lock edge in a closed condition comprising a first elongated hollow holding bracket having a rectangular cross section, a lock edge end and a hinge edge end extending lengthwise across a substantial portion of the one of the door panels between the hinge edge and lock edge thereof, means securing the first holding bracket to the one of the door panels with the lock edge end thereof adjacent to but in substantial spaced relation from the lock edge thereof, a second elongated hollow holding bracket having a rectangular cross section, a lock edge end and a hinge edge end extending for a substantial distance longitudinally between the hinge edge and lock edge of the other of the adjacent door panels, means for securing the second holding bracket to the other of the door panels with the lock edge end thereof adjacent to but in substantial spaced relation from the lock edge of the other of the door panels in longitudinal alignment with the first holding bracket, an elongated hollow cross bolt having a rectangular cross section with exterior dimensions slightly less than the interior dimensions of the holding brackets whereby the cross bolt may be moved into and out of the holding brackets across the lock edges of the door panels, pin means extending across the hinge edge end of the second holding bracket for preventing movement of the cross bolt through the hinge edge end of the second holding bracket and removable locking means extending across the hinge edge end of the first holding bracket for selectively preventing withdrawal of the cross bolt from the hinge edge end of the first holding bracket, said cross bolt extending from the pin means to the locking means substantially the entire distance between the hinge edge ends of the holding brackets in a locking position within the holding brackets, wherein the means for securing the holding brackets to the door panels are secured to the holding brackets at each end thereof and each comprises a threaded stud secured to the holding bracket and extending perpendicularly thereto through the respective door panel, a dual diameter retaining member the smaller diameter end thereof being threadedly engaged with the free end of the stud on the other side of the door panel from the holding brackets, a larger diameter washer positioned between the other side of the door panel and retaining member concentric with and positioned over the stud, a screw extending through the washer and into the other side of the door panel having a one way slotted head, and means securing the retaining member and washer together to prevent relative rotation thereof about the longitudinal axis of the stud, and further including a cylindrical hardened steel bar positioned centrally of the cross bolt so as to extend between the lock edge ends of the first and second holding brackets with the cross bolt positioned between the pin means across the hinge edge of the second holding bracket and the locking means and pins extending transversely of the cross bolt at the opposite ends of the steel bar for securing the steel bar centrally of the cross bolt while permitting rotation thereof relative to the cross bolt, and wherein the cross bolt is of a highly visible color and distinct from the color of the door panel and the holding brackets so as to be highly visible in a locking position between the holding brackets and in an unlocking position extending out of the hinge edge end of the first holding bracket.

2. A lock bar for securing adjacent door panels each having a hinge edge and a lock edge in a closed condition comprising a first elongated hollow holding bracket having a rectangular cross section, a lock edge end and a hinge edge end extending lengthwise across a substantial portion of the one of the door panels between the hinge edge and lock edge thereof, means securing the first holding bracket to the one of the door panels with the lock edge end thereof adjacent to but in substantial spaced relation from the lock edge thereof, a second elongated hollow holding bracket having a rectangular cross section, a lock edge end and a hinge edge end extending for a substantial distance longitudinally between the hinge edge and lock edge of the other of the adjacent door panels, means for securing the second holding bracket to the other of the door panels with the lock edge end thereof adjacent to but in substantial spaced relation from the lock edge of the other of the door panels in longitudinal alignment with the first holding bracket, an elongated hollow cross bolt having a rectangular cross section with exterior dimensions slightly less than the interior dimensions of the holding brackets whereby the cross bolt may be moved into and out of the holding brackets across the lock edges of the door panels, pin means extending across the hinge edge end of the second holding bracket for preventing movement of the cross bolt through the hinge edge end of the second holding bracket, and removable locking means extending across the hinge edge end of the first holding bracket, for selectively preventing withdrawal of the cross bolt from the hinge edge end of the first holding bracket, said cross bolt extending from the pin means to the locking means substantially the entire distance between the hinge edge ends of the holding brackets in a locking position within the holding brackets wherein the means for securing the holding brackets to the door panels are secured to the holding brackets at each end thereof and each comprises a threaded stud secured to the holding bracket and extending perpendicularly thereto through the respective door panel, a dual diameter retaining member the smaller diameter end thereof being threadedly engaged with the free end of the stud on the other side of the door panel from the holding brackets, a larger diameter washer positioned between the other side of the door panel and retaining member concentric with and positioned over the stud, a screw extending through the washer and into the other side of the door panel having a one way slotted head, and means securing the retaining member and washer together to prevent relative rotation thereof about the longitudinal axis of the stud.

3. A lock bar comprising an elongated hollow holding bracket having a rectangular cross section, means for securing the holding bracket to a door panel with one end thereof adjacent but in spaced relation to one edge of the door panel secured to the holding bracket at each end thereof and each of which means for securing the holding bracket to a door panel comprises a threaded stud secured to the holding bracket and extending perpendicularly thereto through the respective door panel, a dual diameter retaining member, the smaller diameter end thereof being threadedly engaged with the free end of the stud on the other side of the door panel from the holding brackets, a larger diameter washer positioned between the other side of the door panel and retaining member concentric with and positioned over the stud, a screw extending through the washer and into the other side of the door panel having a one way slotted head, and means for securing the retaining member and washer together to prevent relative rotation thereof about the longitudinal axis of the stud, an elongated rectangular cross bolt positioned within the holding bracket for longitudinal movement with respect to the holding bracket, fixed means adjacent the one edge of the door panel for receiving one end of the cross bolt, releasable locking means alternatively operable to extend across the other end of the holding bracket for selectively preventing withdrawal of the cross bolt from the fixed means and holding bracket for holding the cross bolt in a locking position and to extend through the one end of the holding bracket and cross bolt for securing the cross bolt to the holding bracket with the cross bolt extending out of the other end of the holding bracket a substantial distance in an unlocking position.

* * * * *